United States Patent [19]

Deline

[11] Patent Number: 4,708,257

[45] Date of Patent: Nov. 24, 1987

[54] PROTECTIVE SEAL FOR A CAN

[76] Inventor: Douglas N. Deline, 1183 W. Phillips ct., Midland, Mich. 48640

[21] Appl. No.: 920,688

[22] Filed: Oct. 20, 1986

[51] Int. Cl.[4] ..... B65D 51/20

[52] U.S. Cl. ..... 220/257; 220/258

[58] Field of Search ..... 220/257, 258, 260, 270, 220/359, 358

[56] References Cited

U.S. PATENT DOCUMENTS 3,204,805 9/1965 May ..... 220/257

3,391,847 7/1968 Christine et al. ..... 220/257

4,167,234 9/1979 Gordon et al. ..... 220/359

*Primary Examiner*—George T. Hall

[57] ABSTRACT

A container such as a beverage container or the like is provided with a protective sealing means in the form of a thin film on at least one end thereof, said sealing means being adapted such that a major portion thereof is releasable attached so as to cover the surface of such container end and a minor portion thereof is securely attached to the container, said major portion of the sealing means being further adapted to curl upon itself after removal thereby exposing the surface of the container.

5 Claims, 2 Drawing Figures

PROTECTIVE SEAL FOR A CAN

BACKGROUND OF THE INVENTION

The present invention relates to a seal for a can or similar container such as a metal can used for soft drinks, beer, juices and the like. More particularly the present invention relates to a thin film adapted to cover the top of such cans and prevent contamination of the top surface of such can by dirt or other foreign substances.

Cans or similar containers made of aluminum, steel or other suitable material provide a convenient means of packaging and transporting a variety of foodstuffs and have met with considerable consumer acceptance. Suitable designs generally are cylindrical shaped, closed containers often provided on at least one end thereof (hereinafter the top) with a means for opening the container. Suitable opening means include the well known pull ring which separates from the can after opening of the can and lift tabs which cause a section of the can top to separate by deforming into the interior of the can upon application of a lifting force. Most generally such opening means are utilized for beverage containers.

Disadvantageously, present designs for cans and in particular beverage cans do not provide a means to prevent contamination of the surface of the can top. Such contamination may be accidental and incidental to transport and storage of the product, or intentionally caused by a terrorist or saboteur. Because the consumer is likely to contact such surface with his or her mouth while drinking from the can, or the can's contents are likely to come in contact with the contaminated surface, it would be desirable to provide a means to prevent such contamination.

SUMMARY OF THE INVENTION

According to the present invention there is now provided a sealing means for preventing the contamination of the end surface of container such as a cylindrical shaped can for beverages and the like, said sealing means being in the form of a thin film which covers the top surface of the container to prevent contact of foreign substances therewith having a projecting portion thereof adapted to be grasped for removal of the sealing means from at least a major portion of the container top and being further adapted to roll upon itself after such removal and to remain attached to the container.

DETAILED DESCRIPTION OF THE INVENTION

Figure 1:
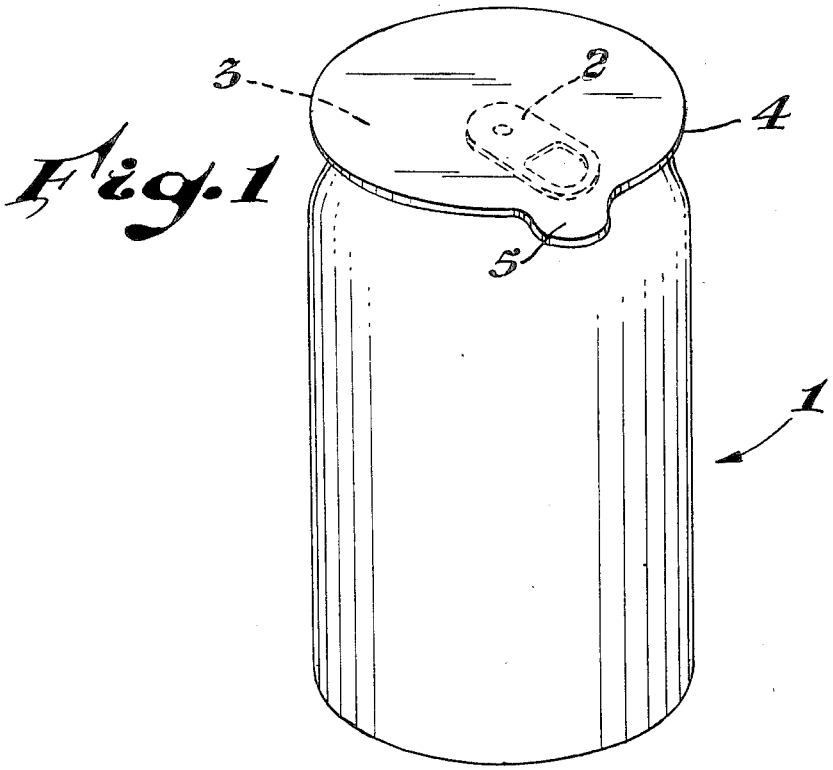
In FIG. 1 there is depicted a container, 1, having an opening means, 2, as an integrel portion of container top, 3. A sealing means according to the invention, 4, having a portion thereof adapted to be grasped for releasing the same, 5, covers the container top thereby preventing contamination of the underlying surface.
Figure 2:
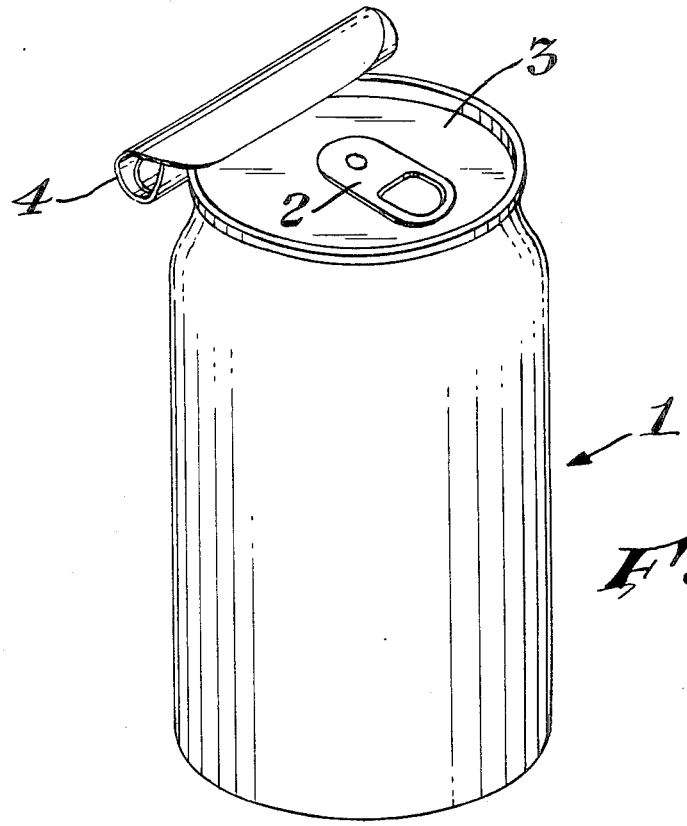
In FIG. 2 the sealing means, 4, has been released from a major portion of the container top and has assumed a coiled configuration thereby exposing the container top and the opening means.

The sealing means according to the present invention may be formed of any suitable material such as metal, plastic, paper, cellophane, and the like. A preferred material of construction is a thermoplastic resin, especially a polyolefin, such as low density polyethylene, linear low density polyethylene, etc. The sealing means is in the form of a thin film, and may be on the order of from about 0.5 to about 20.0 mills (about 0.01 to about 0.5 mm) in thickness.

The sealing means is attached to a majority of the end surface of the container or to a majority of the circumference of the end of the container by any suitable means such that the portion of the sealing means so attached is readily removable from such surface. Suitable methods for releasibly or removably attaching the sealing means in this manner include the use of an adhesive, use of the well known "cling" of certain modified thermoplastic films, or by physical attachment, such as by shrink fitting the sealing means using internal stress forces of the film to maintain the film in contact with the circumference or surface of the container end.

In a preferred embodiment of the invention the sealing means is releasably attached so as to cover a majority of the surface of the container and securely attached at a point elsewhere on the container, preferably also on the surface or circumference of the container end. After release of the major portion of the sealing means it is adapted to roll up into a coil or convoluted structure and remain attached to the container in a manner so as not to interfere with pouring or drinking from the container. When employed as a sealing means for a beverage container further equipped with a self contained opening means, such as a lift tab or pull tab, the sealing means is securely attached to the container or container top at a position nonadjacent to such opening means so as to expose such opening means upon releasing the releasable portion of the sealing means, and not interfere with the use of such opening means thereafter.

Secure attachment of the sealing means to the container may be obtained by selective application of an adhesive capable of developing good adhesion between the sealing means and the container, or by other suitable techniques. Examples of such adhesives include unplasticized polyvinylchloride (PVC), copolymers of ethylene and acrylic acid (EAA), etc.

The sealing means may be caused to coil or roll upon itself after release by any suitable technique. Generally if differing degrees of tension are imparted to the outer and inner surfaces of the sealing means the portion thereof releasably attached to the container end surface will curl upon itself after being released. Such differing degrees of tension may be induced by any suitable technique such as mechanically differentially stretching the film; inducing different molecular orientations or bias in the two surfaces; thermally treating the two surfaces of an oriented film; utilizing a two layer film, one layer of which has a different degree of tension applied thereto or induced therein; or coating a film with a suitable material such as a latex or a thermoplastic resin film which thereafter is able to impart a difference in tension to the coated film source. Because the sealing means desirably is not removed completely from the container after it is released it does not contribute to litter.

What is claimed is:

1. A cylindrical shaped container having two ends at least one of which is provided with a protective sealing means comprising a thin film of a generally circular shape having a diameter substantially corresponding to the diameter of the cylindrical container, a major portion of the sealing means being removable attached so as to cover the surface of the container end and a minor portion of which is securely attached to the container, and wherein the major portion of the sealing means is adapted to coil upon itself after detachment from the container end.

2. A container according to claim 1 wherein the sealing means further comprises a projection adapted to be grasped for purposes of removing the sealing means from the container end.

3. A beverage container according to claim 1 wherein the end provided with a sealing means further comprises an opening means.

4. A beverage container according to claim 3 wherein the opening means is exposed upon removal of the major portion of the sealing means.

5. A container according to claim 1 wherein the sealing means comprises a film of a thermoplastic resin.

* * * * *